US007223942B2

(12) United States Patent
Konishi et al.

(10) Patent No.: US 7,223,942 B2
(45) Date of Patent: May 29, 2007

(54) CERAMIC HEATER, GLOW PLUG, AND CERAMIC HEATER MANUFACTURING METHOD

(75) Inventors: Masahiro Konishi, Kariya (JP); Haruhiko Sato, Aichi (JP); Tetsuya Suzuki, Komaki (JP); Takahiro Matsui, Komaki (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 11/168,534

(22) Filed: Jun. 29, 2005

(65) Prior Publication Data

US 2006/0011602 A1 Jan. 19, 2006

(30) Foreign Application Priority Data

Jun. 29, 2004 (JP) ..... P. 2004-191025
Jun. 29, 2004 (JP) ..... P. 2004-191027

(51) Int. Cl.
*F23Q 7/22* (2006.01)
*F02N 17/00* (2006.01)

(52) U.S. Cl. ..... 219/270; 123/179.6

(58) Field of Classification Search ..... 219/270, 219/267, 538, 539, 542, 544, 552; 123/179.6; *F23Q 7/22*
See application file for complete search history.

(56) References Cited

U.S. PATENT DOCUMENTS 5,883,360 A * 3/1999 Tatematsu et al. ..... 219/270
6,204,481 B1 * 3/2001 Ito ..... 219/270
6,414,273 B1 * 7/2002 Taniguchi et al. ..... 219/270
6,563,089 B2 * 5/2003 Watanabe et al. ..... 219/270
6,646,231 B2 * 11/2003 Hotta et al. ..... 219/270
6,653,601 B2 * 11/2003 Taniguchi et al. ..... 219/270
6,720,530 B2 * 4/2004 Taniguchi et al. ..... 219/270
6,844,525 B2 1/2005 Yoshikawa et al.
6,881,930 B2 * 4/2005 Yoshikawa et al. ..... 219/270

FOREIGN PATENT DOCUMENTS

JP 2002-364842 12/2002

* cited by examiner

*Primary Examiner*—Daniel Robinson
(74) *Attorney, Agent, or Firm*—Sughrue Mion, PLLC

(57) ABSTRACT

A ceramic heater which includes: a cylindrical substrate including an insulator; a resistor provided in one end side of the substrate; a pair of lead parts provided in the substrate, connected to the resistor and extending to an opposite end side of the substrate; and a pair of electrode parts exposed to a surface at an opposite end side of the substrate and connected respectively to the lead parts. Both lead parts are made of the same material as both electrode parts. An axial cross-sectional area of the electrode part is equal to or larger than a cross-sectional area of the lead part in a direction perpendicular to an axis of the ceramic heater.

7 Claims, 5 Drawing Sheets

CERAMIC HEATER, GLOW PLUG, AND CERAMIC HEATER MANUFACTURING METHOD

BACKGROUND OF THE INVENTION

1. Field of the Invention

This invention relates to a ceramic heater, a glow plug, and a ceramic heater manufacturing method.

2. Description of the Related Art

JP-A-2003-56848 discloses a glow plug including a cylindrical metal shell, a columnar ceramic heater provided inside the tip end side of the metal shell and having a heating part at its tip end, and a center pole provided in the rear end side of the metal shell.

The ceramic heater of JP-A-2003-56848 has a cylindrical substrate made of a silicon nitride insulating material, a resistor buried in one end side of the substrate, a pair of lead parts buried in the substrate, the lead parts being connected to the resistor and extending to an opposite end side of the substrate, and electrode parts exposed at the opposite end surface of the substrate and connected to the lead parts. The ceramic heater of JP-A-2003-56848 has a metal cylinder and a metal ring on its outer periphery; one electrode part is electrically connected to the metal shell through the metal cylinder and the other electrode part is electrically connected to the center pole through the metal ring.

The resistor, the lead parts, and the electrode parts constitute a fired body made of an insulting material of silicon nitride and tungsten carbide (WC), for example. In this case, the lead parts and the electrode parts each has a larger WC content than that of the resistor, and accordingly has a higher electrical conductivity than the resistor.

The metal shell of the glow plug is fixed to a cylinder head of a diesel engine and the center pole is connected to a battery. In the ceramic heater, a voltage is applied between the metal shell and the center pole, whereby the resistor is energized through the electrode part and the lead part, to generate heat. Accordingly, the glow plug is utilized when starting the diesel engine and while idling.

This type of ceramic heater is manufactured as follows: First, for example, a resistor green part which is to become a resistor is injection-molded with a material having a decreased WC content and then a lead green part which is to become a lead part and an electrode part are injection-molded with a material having an increased WC content to provide a one-piece molded green body including the resistor green part and the lead green part.

The molded green body thus prepared is fitted into a substrate green body which is to become a substrate, and is pressed to produce a green body assembly. Then, the green body assembly is subjected to a debinder treatment and fired at 1700° C. or higher, for example, in the vicinity of about 1800° C. with a hot press, etc. The fired body thus obtained is ground to produce a ceramic heater.

As compared with a ceramic heater having a lead part and an electrode part made of metal wires, the ceramic heater having the resistor, the lead part, and the electrode part sintered from materials together with the substrate green body eliminates the need for a metal lead wire manufacturing process of bending and cutting wires made of W, W—Re alloy, etc. In addition, the lead parts and the electrode parts can be molded together with the resistor. Thus, as compared with the former ceramic heater, the latter has the advantage of high mass productivity. Thus, for example, the ceramic heater as described above enables a thin glow plug to be manufactured at low cost.

3. Problems to be Solved by the Invention

However, there is a strong need to enhance the long term durability of this kind of ceramic heater. For example, there is a need to suppress break-resistant strength degradation of the ceramic heater with use as a measure of durability. Particularly, recent high performance diesel engines require a small and thin glow plug. In such a glow plug, a ceramic heater having a substrate measuring about 3.5 mm or less in diameter is required, and the problem of long term durability becomes evident.

SUMMARY OF THE INVENTION

It is therefore an object of the invention to provide a ceramic heater having high durability over long term use.

To provide such a ceramic heater, the present inventors conducted research and found that degradation of the break-resistant strength of a ceramic heater is caused by degradation of an electrode part. The inventors also found that degradation of the electrode part is caused by oxidation which results in swelling of the electrode part. Further, the inventors found that when both lead parts are made of the same material as both electrode parts, if the axial cross-sectional area of the electrode part is smaller than the cross-sectional area of the lead part in a direction perpendicular to the axis of the ceramic heater, then oxidation of the electrode part is promoted. The inventors thus conceived the present invention.

That is, the present invention provides a ceramic heater including a cylindrical substrate containing an insulator, a resistor provided in one end side of the substrate, a pair of lead parts provided in the substrate so that the lead parts are connected to the resistor and extend to an opposite end side of the substrate, and a pair of electrode parts exposed at a surface of the opposite end side of the substrate and connected respectively to the lead parts, characterized in that both lead parts are made of the same material as both electrode parts and the axial cross-sectional area of the electrode part is equal to or larger than the cross-sectional area of the lead part in a direction perpendicular to the axis of the ceramic heater.

In the ceramic heater of the invention, when both lead parts and both electrode parts are made of the same material, if the axial cross-sectional area of the lead part of the electrode part is equal to or larger than the cross-sectional area of the lead part in a direction perpendicular to the axis of the ceramic heater, the electrical resistance R (Ω) is represented by the cross-sectional area a ($m^2$); length l (m), and material property constant (volume resistivity) ρ as follows:

$$R=\rho \cdot l/a \qquad \text{(Expression 1)}$$

Therefore the electrical resistance of the electrode part becomes equal to or less than that of the lead part, such that the electrode part resists an increase in temperature as compared with the lead part. Consequently, oxidation of the electrode part that may be exposed to oxygen in the open air is suppressed. Thus, swelling of the electrode part is suppressed, so that it is possible to suppress break-resistant strength degradation of the ceramic heater.

If the axial cross-sectional area of the electrode part is equal to or larger than the cross-sectional area of the lead part in a direction perpendicular to the axis of the ceramic heater, for example, in a glow plug, the connection part for energizing one electrode part through a metal ring from a center pole and the connection part for energizing the other electrode part through a metal cylinder from a metal shell can be made sufficiently large. Thus, the electrical resistance value of each of the connection parts becomes the smallest in the energization paths of the ceramic heater. Consequently, heat generation in both the connection parts can be suppressed, and the problem of a broken wire in the connection part caused by thermal stress produced by repeating heating and cooling can be prevented.

Therefore, the ceramic heater of the invention demonstrates long term high durability.

JP-A-2-75188 and JP-A-2-75189 disclose ceramic heaters each having a lead part, the axial length of both electrode parts being equal to or larger than the width in a direction perpendicular to the axis of the lead part. However, these patent publications do not disclose and do not suggest the thicknesses of the electrode part and the lead part. Moreover, these patent publications do not consider how the break-resistant strength changes depending on the relationship between the axial cross-sectional area of both the electrode parts and the lead parts in a direction perpendicular to the axis of the ceramic heater.

In the ceramic heater of the invention, the substrate is preferably a cylindrical substrate containing an insulator comprising silicon nitride, etc. The insulator comprising silicon nitride is obtained by bonding principal phase particles consisting mainly of silicon nitride ($Si_3N_4$) via a grain boundary phase derived from a sintering aid component, etc., described below. In the principal phase, a part of Si or N may be replaced with Al or O, or metal atoms such as Li, Ca, Mg, Y, etc., may be dissolved therein.

The resistor is provided in one end side of the substrate. The resistor can be formed of electrically conductive ceramic and insulating ceramic.

As the electrically conductive ceramic, a known material of WC, molybdenum disilicide ($MoSi_2$), tungsten disilicide ($WSi_2$), etc., for example, can be adopted.

As the electrically conductive ceramic, for example, if the lead part is a fired body containing WC, preferably WC is adopted to reduce the difference in linear thermal expansion coefficient between the resistor and the lead part containing WC so as to enhance the thermal shock resistance of the joint part of the resistor and the lead part. Accordingly, while the content ratio between the insulating ceramic and WC is changed to enhance thermal shock resistance, the electrical resistivity of the resistor can be adjusted to any desired value.

As the insulating ceramic, a silicon nitride material can be adopted to reduce the difference in linear thermal expansion coefficient between the resistor and the substrate made of an insulator comprising silicon nitride so as to enhance thermal shock resistance. Accordingly, while the content ratio between the electrical conductive ceramic and the silicon nitride is changed to enhance thermal shock resistance, the electrical resistivity of the resistor can be adjusted to any desired value.

The lead parts are a pair of shaft bodies provided in the substrate, connecting to the resistor and extending to the opposite end side of the substrate. The lead parts form part of the energization path between the resistor and power supply, and thus must exhibit characteristics of high conductivity, low heat generation property, etc., as compared with the resistor.

The electrode parts are exposed at the surface of the opposite end side of the substrate and are connected to respective lead parts. Like the lead parts, the electrode parts also form part of the energization path between the resistor and the power supply, and thus must have characteristics of high conductivity, low heat generation property, etc., as compared with the resistor.

In the ceramic heater of the invention, both lead parts are made of the same material as both electrode parts. In this case, the lead parts and the electrode parts can be manufactured according to any of (1) a method of using electrically conductive ceramic and insulating ceramic of the same kind and varying their content, (2) a method of adopting different kinds of electrically conductive ceramic and insulating ceramic differing in electrical resistivity, (3) a method of using (1) and (2) in combination, or the like for the component material of the resistor.

In this case, in the ceramic heater manufacturing process, it is possible to form a green body which is to become the lead parts and the electrode parts in one injection molding. Thus, after a resistor green part which is to become the resistor is injection-molded, a pair of lead green parts which is to become a pair of lead parts and the electrode parts can be injection-molded to provide a single molded green body including the resistor green part and the lead green parts. The resistor can also be a fired body made of the same material as the lead parts and the electrode parts.

Preferably, the axial cross-sectional area of the electrode part is 1.5 times or more than the cross-sectional area of the lead part in a direction perpendicular to the axis of the ceramic heater. In this manner, the temperature rise of the electrode part is effectively suppressed, so as to effectively suppress degradation of break-resistant strength caused by oxidation of the electrode part.

In the ceramic heater of the invention, for example, when the ceramic heater is attached to the metal shell, etc., at the time of manufacturing the glow plug, there is a concern that an excessive load may be imposed on the ceramic heater in a fitting step, a brazing step, etc. For example, in the glow plug disclosed in JP-A-2002-364842, a metal cylinder and a metal ring must be installed on the outer periphery of a ceramic heater and when they are installed, there is a concern that an excessive load may be imposed on the ceramic heater.

In handling a glow plug, particularly at the time of attaching the glow plug to a cylinder head of a diesel engine, etc., there is a concern that the glow plug may be handled too roughly or may be fastened too strongly with a labor saving device such as an impact wrench, thereby imposing excessive load on the ceramic heater.

Thus, the inventors conducted research to provide a ceramic heater having sufficient break-resistant strength for suppressing breakage, etc., during manufacturing or installation (e.g., attaching, mounting or fitting to a cylinder head), etc. The inventors have furthermore advanced the art according to the following analysis:

First, a conventional ceramic heater has a structure in which an electrode part is provided in a substrate in the vicinity of fit portions of a metal cylinder, a metal ring, a metal shell, etc. It is easy to break the electrode part in the glow plug manufacturing process, for example, and part of the electrode part is exposed to the outer peripheral surface of the ceramic heater. Thus, the break-resistant strength of the ceramic heater depends largely on the strength of the electrode part. Particularly in the electrode part containing WC, not only the strength, but also the characteristics of electrical conductivity, heat generation property, etc., vary largely depending on the compounding ratio between the insulating material comprising silicon nitride and WC.

As for the strength of the electrode and lead parts, JP-A-2002-364842 discloses that if the compounding ratio of WC is increased to 30% by volume, solidification by firing becomes difficult and strength is easily impaired. JP-A-2002-364842 also describes that the insulating silicon nitride material of another component of the electrode part and the lead part is blended with sintering aids for solidifying the organization of the electrode part and the lead part. However, JP-A-2002-364842 does not disclose any specific criteria for the selection and compounding ratio of desired materials to provide an electrode part having the requisite characteristics of high strength, high conductivity, low heat generation property, etc., at the same time. Thus, break-resistant strength is not necessarily stably enhanced in the art related ceramic heaters.

JP-A-62-233619, JP-A-9-184627, and JP-A-2003-229236 each discloses a ceramic heater formed with both a lead part and an electrode part by bending a metal lead wire at a plurality of points. In JP-A-2003-229236, the lead part and electrode part are proposed to be formed of a metal lead wire made of W, W—Re alloy, etc., in consideration of preventing breakage. However, in every ceramic heater described in the above patent publications, a metal lead wire forms both a lead part and an electrode part by bending a wire of W, W—Re alloy, etc., at a plurality of points, whereas an electrode part constituting a part of a fired body is employed in the invention. Therefore, the technical field of the above patent publications significantly differs from that of the invention.

Thus, to provide a ceramic heater having sufficient break-resistant strength for suppressing breakage, etc., during manufacturing or installation, etc., it becomes important to consider both selection and the optimum compounding ratio of the materials making up the electrode part of the fired body, and to determine a specific range in which the required characteristics of electrical conductivity, strength, etc., can be accomplished at the same time.

The inventors examined the electrode part made of a fired body by conducting complex tests. The inventors selected an insulating material comprising silicon nitride and WC, selected $SiO_2$ and $RE_2O_3$ (RE is a rare-earth element) as components of the insulating material, and then they determined appropriate compounding ratios. Thus, the inventors have furthermore advanced the art.

In the ceramic heater of the invention, the substrate preferably contains silicon nitride, each of the electrode parts is part of a fired body containing 30% to 35% by weight of an insulting material comprising silicon nitride and 65% to 70% by weight of WC, and 100% by weight of the insulating material contains 10% to 20% by weight of at least one of $SiO_2$ and $RE_2O_3$ (RE is a rare-earth element). In the ceramic heater of the invention, the lead parts are made of the same material as the electrode parts.

In the ceramic heater of the invention, the electrode parts exposed at the surface on the opposite end side of the substrate and connected to respective lead parts are each made of the insulting material comprising silicon nitride and WC. The insulting material preferably also contains at least one of $SiO_2$ and $RE_2O_3$. As for the compounding ratio between the insulting material and WC and the compounding ratio between $SiO_2$ and $RE_2O_3$ in the insulting material, the inventors determined and defined a proper range for enhancing the electrical conductivity of the electrode part, solidifying the electrode part, and enhancing the strength of the electrode part by conducting the experiments and evaluation described below.

The electrode part is manufactured at a compounding ratio, whereby the break-resistant strength of the ceramic heater in which the electrode part is buried becomes stably high. Thus, the ceramic heater has sufficient break-resistant strength, so that breakage, etc., during manufacturing or installation, etc., can be suppressed.

In the electrode part according to the invention, the insulating material forming the insulating ceramic comprises silicon nitride. The electrode part is made of the same silicon nitride material as the substrate so as to make the linear thermal expansion coefficients of the substrate and the electrode part roughly equal. The insulating material preferably also contains $SiO_2$ and $RE_2O_3$ as sintering aids in addition to silicon nitride. The electrode part of the ceramic heater of the invention more preferably contains both $SiO_2$ and $RE_2O_3$, as opposed to only one or the other. The insulating material can also contain other sintering aids without particular limitation or unavoidable impurities.

The rare-earth elements forming $RE_2O_3$ of the electrode part according to the invention can include scandium (Sc), yttrium (Y), and lanthanide lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu) belonging to subgroup IIIa of the periodic table.

In the ceramic heater of the invention, if the insulting material comprising silicon nitride of the electrode part exceeds 35% by weight the WC content is less than 65% by weight, the heat generation of the electrode part becomes too large and the heat generation efficiency of the resistor worsens.

On the other hand, in the ceramic heater of the invention, if the insulting material comprising silicon nitride of the electrode part is less than 30% by weight and the WC content exceeds 70% by weight, it becomes difficult to solidify the electrode part.

In the ceramic heater of the invention, if 100% by weight of the insulating material of the electrode part contains less than 10% by weight of $SiO_2$ and $RE_2O_3$, even if the compounding ratio between the insulating material and WC in the electrode part is set within the preferred range described above, solidification of the electrode part becomes insufficient, the linear thermal expansion coefficient lessens, and the linear thermal expansion coefficient difference between the substrate and the electrode part increases. Thus, the break-resistant strength of the single unit ceramic heater is substantially worsened.

On the other hand, in the ceramic heater of the invention, if 100% by weight of the insulating material of the electrode part contains an amount exceeding 20% by weight of $SiO_2$ and $RE_2O_3$, even if the compounding ratio between the insulating material and WC in the electrode part is set within the preferred range described above, the linear thermal expansion coefficient of the electrode part increases and the linear thermal expansion coefficient difference between the substrate and the electrode part becomes too large. Thus, for the ceramic heater, a new problem of lessened durability arises leading to a broken conduction path in the electrode part or vicinity thereof, caused by thermal stress produced by repeated heating and cooling.

The ceramic heater of the invention can provide a noticeable advantage if the substrate is about 3.5 mm or less in diameter. This is because the ceramic heater of the invention having a small diameter can stably exhibit high durability as compared with conventional ceramic heaters of the same diameter. Particularly, in recent years, the diesel engine has required a ceramic heater having a substrate measuring 3.5 mm or less in diameter from the viewpoint of high performance direct injection of fuel, etc. To apply the ceramic heater of the invention to such a diesel engine, the possibility of breakage of the ceramic heater can be reduced to extremely low levels, so as to contribute to high performance of the diesel engine.

According to the invention, a glow plug is provided including a cylindrical metal shell, a columnar ceramic heater provided in the tip end side of the metal shell and having a heating part at its tip end, and a center pole provided in the rear end side of the metal shell, characterized as having a ceramic heater as described above. In this case, the glow plug contributes to high performance of the diesel engine due to its thin diameter and high durability.

According to the invention, a ceramic heater manufacturing method is provided which includes:

forming a molded green body using a molding tool, the molded green body including a resistor green part which becomes a resistor after firing, a pair of lead green parts which becomes a pair of lead parts after firing, and a pair of electrode green parts which becomes a pair of electrode parts after firing; and firing a green body assembly including a substrate green body which becomes a substrate after firing and the molded green body which is provided in the substrate green body so as to form a ceramic heater including a substrate, a resistor, a pair of lead parts, and a pair of electrode parts, wherein each of the lead green parts includes a rod part which becomes the lead part after firing and a projection part integrated with the rod part and which becomes the electrode part after firing, characterized in that the molding tool includes a first mold and a second mold, each of said first and second molds having a joint face at which said first and second molds can be separated from each other, and a cavity for forming the molded green body, and wherein the cavity of each of the first and second molds includes a pair of opposing inclined sidewalls for forming the electrode green parts, the inclined sidewalls approaching each other as the distance from the joint face increases.

In this case, since the sidewalls have an appropriate draft angle, when the molded green body molded with the molding tool is removed from the first and second molds, the occurrence of cracking defects, chipping, etc., in both projection parts of the molded green body can be suppressed. Thus, the strength of the ceramic heater manufactured using the molded green body can be maintained and an increase in contact resistance of the electrode part can also be suppressed.

In the ceramic heater manufacturing method of the invention, preferably the sidewall is inclined at an angle of 70 to 80 degrees with respect to the joint face. According to the test results of the inventors, in this case, when the inclined sidewalls have an appropriate draft angle, the occurrence of cracking defects, chipping, etc., in both projection parts of the molded green body can be more effectively suppressed.

On the other hand, if the sidewall is inclined at an angle larger than 80° with respect to the joint face, the draft angle becomes insufficient and the molded green body cannot easily be removed. Thus, cracking defects, chipping, etc., readily occur in both projection parts of the molded green body. If the sidewall is inclined at an angle smaller than 70° with respect to the joint face, the molded green body can be readily removed, but a part of the projection part which becomes a ridgeline in the presence of the joint face tends to be sharpened where stress concentrates, and cracking defects, chipping, etc., readily occur in both projection parts of the molded green body.

DESCRIPTION OF REFERENCE NUMERALS

Figure 1:
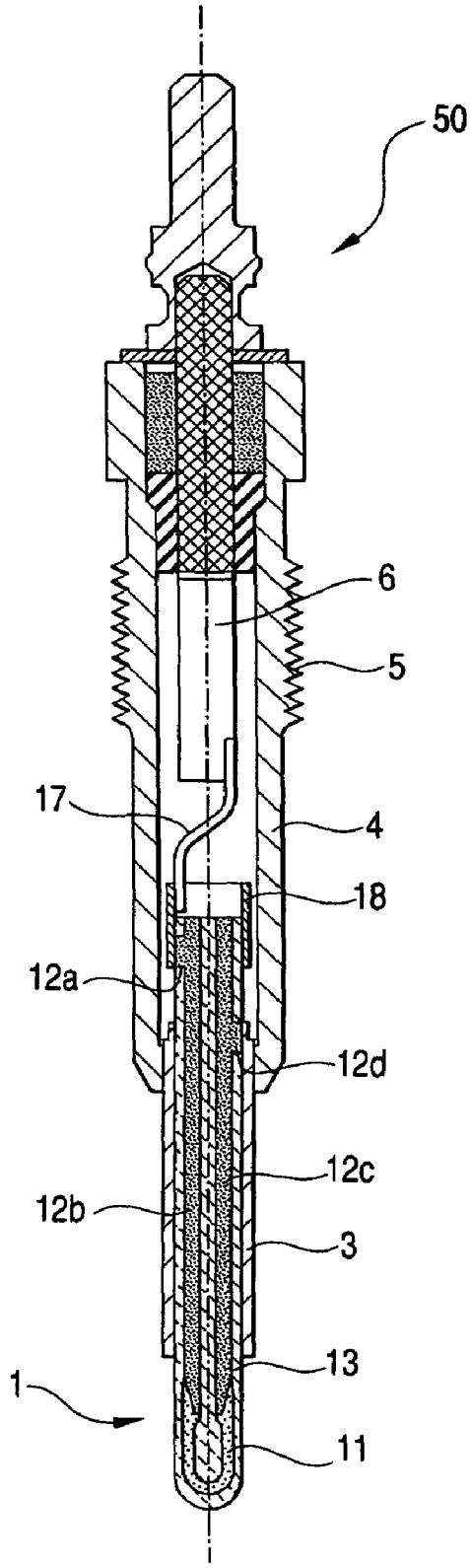
FIG. 1 is a sectional view of a glow plug incorporating a ceramic heater as used in Test Examples 1, 2.

Reference numerals used to identify various structural features in the drawings include the following.

1: Ceramic heater
4: Metal shell
6: Center pole
11: Resistor
12*b*, 12*c*: Lead part
12*a*, 12*d*: Electrode part
13: Substrate
30: Green body assembly
36, 37: Substrate green body (36: Second substrate green body, 37: First substrate green body)
40: Molded green body
50: Glow plug
51: Resistor green part
52: Lead green part
52*a*, 52*d*: Projection parts
52*b*, 52*c*: Rod parts
90: Moding tool
91: First mold
92: Second mold
91*a*, 92*a*: Joint face
91*b*, 92*b*: Sidewall
93: Cavity
S1: Axial cross-sectional area of electrode part
S2: Cross-sectional area in a direction perpendicular to an axis of the lead part
α: Incline angle of sidewall with respect to joint face

DETAILED DESCRIPTION OF THE INVENTION

Test Examples 1 and 2 embodying the invention will now be discussed with reference to the accompanying drawings. However, the present invention should not be construed as being limited thereto. Test Example 1 includes Examples 1-1 to 1-3 and Comparative Examples 1-1 and 1-2. Test Example 2 includes Examples 2-1 to 2-8 and Comparative Examples 2-1 to 2-9.

TEST EXAMPLE 1

Figure 2:
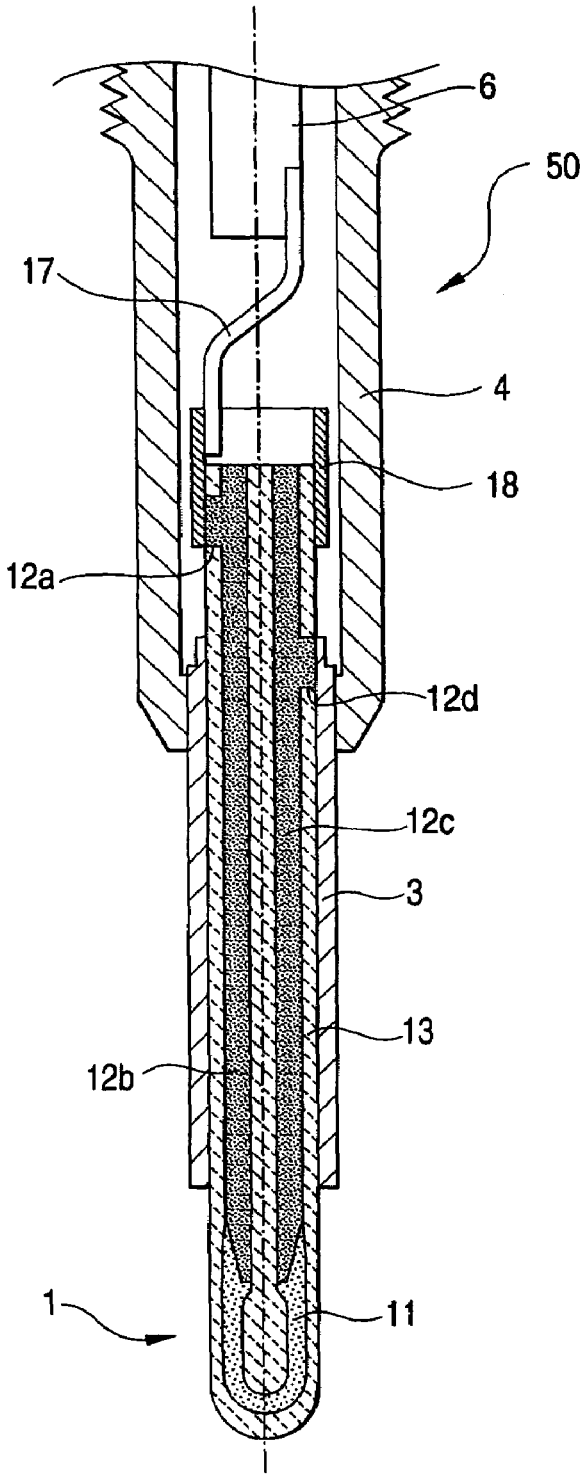
FIG. 2 is an enlarged sectional view of the main part of the glow plug incorporating the ceramic heater as used in Test Examples 1, 2.

Test Example 1 was carried out to determine durability of a ceramic heater over long term use. First, a glow plug 50 employing a ceramic heater 1 of Examples 1-1 to 1-3 and Comparative Examples 1-1 and 1-2 as shown in FIGS. 1 and 2 will be discussed. The glow plug 50 includes a cylindrical metal shell 4, a columnar ceramic heater 1 provided inside the tip end side of the metal shell 4 through a metal cylinder 3 and having a heating part at its tip end, a center pole 6 provided in the rear end side of the metal shell 4, and a connection fitment 17 and a metal ring 18 for connecting the center pole 6 and the rear end part of the ceramic heater 1.

The ceramic heater 1 has a cylindrical substrate 13 made of an insulator comprising silicon nitride, a resistor 11 buried in one end side of the substrate 13, a pair of lead parts 12*b* and 12*c* buried in the substrate 13, connecting to the resistor 11 and extending to an opposite end side of the substrate 13, and electrode parts 12*a* and 12*d* exposed at a side face of the opposite end side of the substrate 13 and connected to the lead parts 12*b* and 12*c*, respectively. The one electrode part 12*d* is electrically connected to the metal shell 4 through the metal cylinder 3 and the other electrode part 12*a* is electrically connected to the center pole 6 through the metal ring 18 and the connection fitment 17.

That is, the rear end part of the connection fitment 17 is fixed to the front end part of the center pole 6 and the metal ring 18 is fixed to the front end part of the connection fitment 17. The metal ring 18 is fitted into the rear end part of the ceramic heater 1 and is in contact with the exposed face of the one electrode part 12*a*. Accordingly, the center pole 6 is electrically connected to the one electrode part 12*a* through the connection fitment 17 and the metal ring 18.

The metal cylinder 3 is fitted into the center of the ceramic heater 1. The metal cylinder 3 is in contact with the other electrode part 12*d*. Accordingly, the metal shell 4 is electrically connected to the other electrode part 12*d* through the metal cylinder 3.

nection fitment 17, the metal ring 18, the one electrode part 12*a*, the lead part 12*b*, the resistor 11, the lead part 12*c*, the other electrode part 12*d*, the metal cylinder 3, and the metal shell 4 in this order, and the heating part at the tip end of the ceramic heater 1 generates heat. Thus, the diesel engine is preheated in the combustion chamber.

Figure 3:
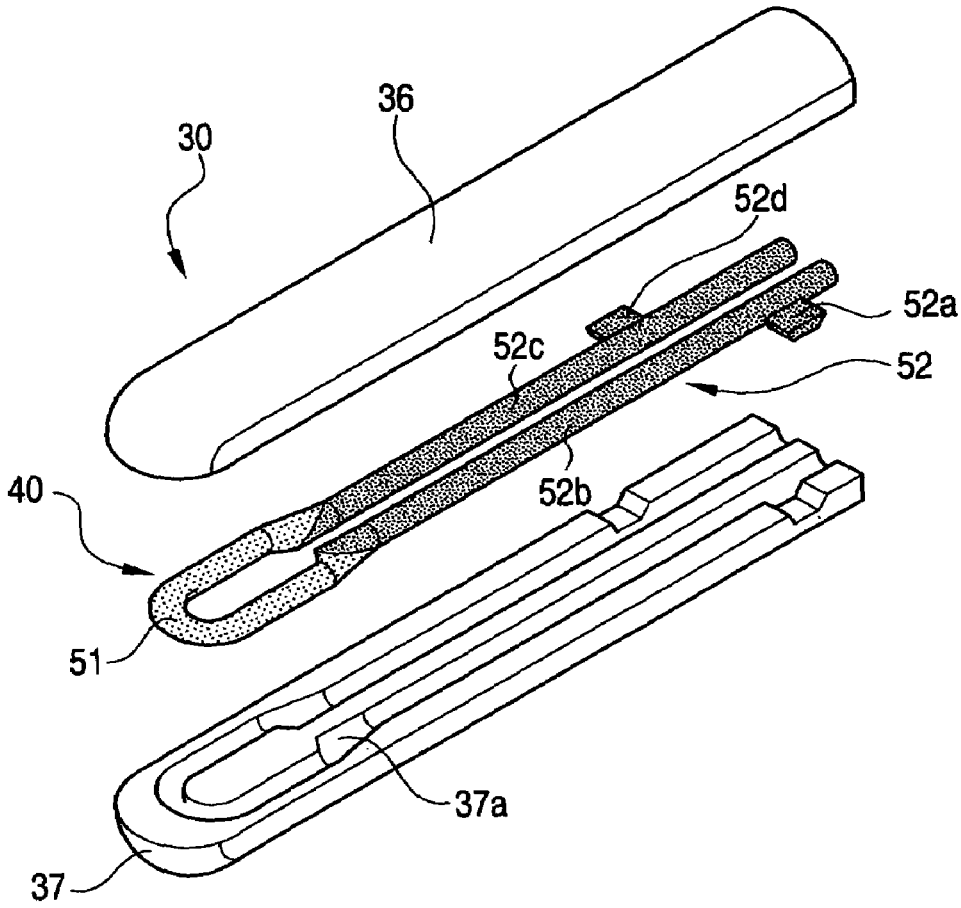
FIG. 3 is a perspective view showing part of a manufacturing process of the ceramic heater as used in Test Examples 1, 2.

The following ceramic heaters of Examples 1-1 to 1-3 and Comparative Examples 1-1 and 1-2 were manufactured as the ceramic heater 1 of the glow plug 50:

First, the following resistor material was prepared by mixing $Si_3N_4$ powder, WC powder, $SiO_2$ powder, $Er_2O_3$ powder, and a thermoplastic resin so as to provide a compounding ratio of 30% by weight of $Si_3N_4$, 63% by weight of WC, 2% by weight of $SiO_2$, and 5% by weight of $Er_2O_3$ after firing. Impurities were not taken into account. After this, a resistor green part 51 was injection-molded with the resistor material as shown in FIG. 3.

Next, the following electrode part and lead part material were prepared by mixing $Si_3N_4$ powder, WC powder, $SiO_2$ powder, $Er_2O_3$ powder, and a thermoplastic resin so as to provide a compounding ratio between the insulating material and WC as indicated in Table 1 after firing. The ratio between $SiO_2$ powder and $Er_2O_3$ powder was similar to that of the resistor material. Table 1 lists the content (% by weight) of the insulating material made up of $Si_3N_4$, $SiO_2$ and $Er_2O_3$ and conductive WC, the content (% by weight) of $SiO_2$ and $Er_2O_3$ being based on 100% by weight of the insulating material. Thus, the electrode part and lead part material contained more conductive WC powder than the resistor material.

TABLE 1

| | Insulating material (% by weight) | WC (% by weight) | Content (% by weight) of ($SiO_2$ + $Er_2O_3$) in insulating material {($SiO_2$ + $Er_2O_3$)/insulating material} | Axial cross-sectional area of electrode part/cross-sectional area in direction perpendicular to axis of lead part (S1/S2) |
|---|---|---|---|---|
| Example 1-1 | 33 | 67 | 15 | 1.0 |
| Example 1-2 | 33 | 67 | 15 | 1.5 |
| Example 1-3 | 33 | 67 | 15 | 2.0 |
| Comparative Example 1-1 | 33 | 67 | 15 | 0.5 |
| Comparative Example 1-2 | 33 | 67 | 15 | 0.8 |

The electrode parts 12*a* and 12*d* and the lead parts 12*b* and 12*c* constitute a fired body made of an insulting material and WC. The insulting material comprises silicon nitride. The electrode parts 12*a* and 12*d* and the lead parts 12*b* and 12*c* each have a larger WC compounding ratio for providing higher electrical conductivity than that of the resistor. The electrode parts 12*a* and 12*d* and the lead parts 12*b* and 12*c* are made of the same material (they are the same in blended material types and compounding ratio).

The metal shell 4 is formed on the outer peripheral surface and has a threaded part 5 for attachment to a cylinder head, etc. A cap (not shown) is fitted into the rear end part of the center pole 6. The threaded part 5 of the metal shell 4 is screwed into a cylinder head of a diesel engine. Accordingly, the tip end part of the ceramic heater 1 is positioned in a combustion chamber of the diesel engine. The cap connected to the rear end part of the center pole 6 is connected to a battery. Current flows through the center pole 6, the con- After this, lead green parts 52 were injection-molded with the electrode part and lead part material with the resistor green part 51 remaining. At that time, in the lead green parts 52, rod parts 52*b* and 52*c* which will become the lead parts 12*b* and 12*c* and projection parts 52*a* and 52*d* which will become the electrode parts 12*a* and 12*d* integral with the rod parts 52*b* and 52*c* are molded at the same time. Thus, a one-piece molded green body 40 including the resistor green part 52 and the lead green parts 51 was obtained.

Figure 4:
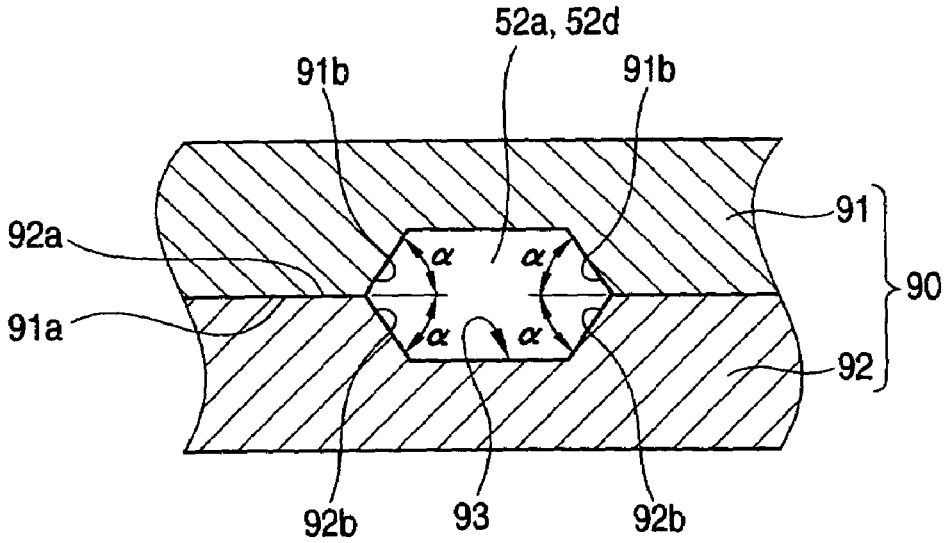
FIG. 4 is an enlarged sectional view of the main part of a first mold and a second mold of the ceramic heater as used in Test Examples 1, 2.

At this time, the projection parts 52*a* and 52*d* form a rough hexagon having a long dimension in the axial direction as shown in FIG. 4, so that the molded green body 40 can be drawn out from a molding tool 90.

More particularly, the molding tool 90 is made up of a first mold 91 and a second mold 92. The first mold 91 and the second mold 92 have a cavity 93 in which the molded green body 40 can be molded, and can be separated from each other at the joint faces 91*a* and 92*a*. Inclined sidewalls 91*b* and 92*b* approach each other as the distance from the joint faces 91*a* and 92*a* increases. The pair of inwardly sloped opposing sidewalls 91*b* and 92*b* are formed in a portion of the cavity 93 in the first mold 91 and the second mold 92 where both projection parts 52*a* and 52*d* are molded. The incline angle α of the sidewalls 91*b*, 92*b* with respect to the joint faces 91*a*, 92*a* is 75 degrees. Thus, the sidewalls 91*b* and 92*b* have an appropriate draft angle and consequently, when both the projection parts 52*a* and 52*d* of the molded green body 40 are removed, cracking defects, chipping, etc., rarely occur.

On the other hand, a first substrate green body 37 forming about a half of the substrate 13 after firing was prepared by molding a mixed powder made of $Si_3N_4$ powder and $Er_2O_3$ powder so as to provide a compounding ratio of 90% by weight of $Si_3N_4$ and 10% by weight of $Er_2O_3$ after firing. The first substrate green body 37 was formed with a recess part 37*a* for housing the molded green body 40. The molded green body 40 thus prepared was housed in the recess part 37*a* of the first substrate green body 37. After this, the above-mentioned mixed powder was placed on the side of the molded green body 40 and press molding was performed, whereby a second substrate green body 36 forming the rest of substrate 13 was also formed. A green body assembly 30 thus prepared was heated to 80° C. as a debinder treatment and was further fired at about 1800° C. with a hot press.

Figure 5:
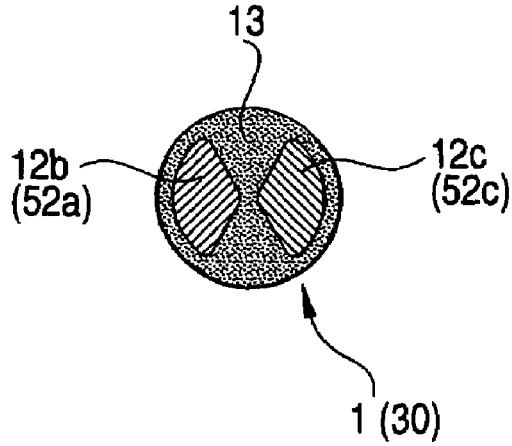
FIG. 5(A) is a sectional view of the lead parts of the ceramic heater as used in Test Examples 1, 2.
FIG. 5(B) is a sectional view of the electrode parts of the ceramic heater.
FIG. 5(C) is a side view of the electrode part.
Figure 5:
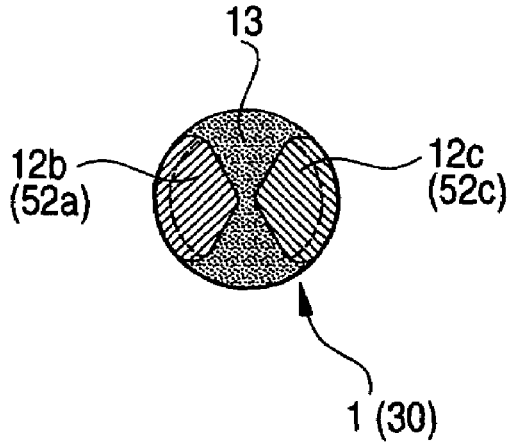
Figure 5:
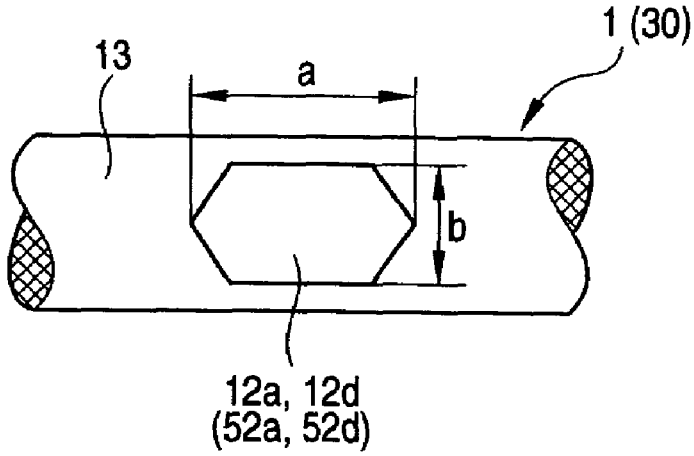
Figure 6:
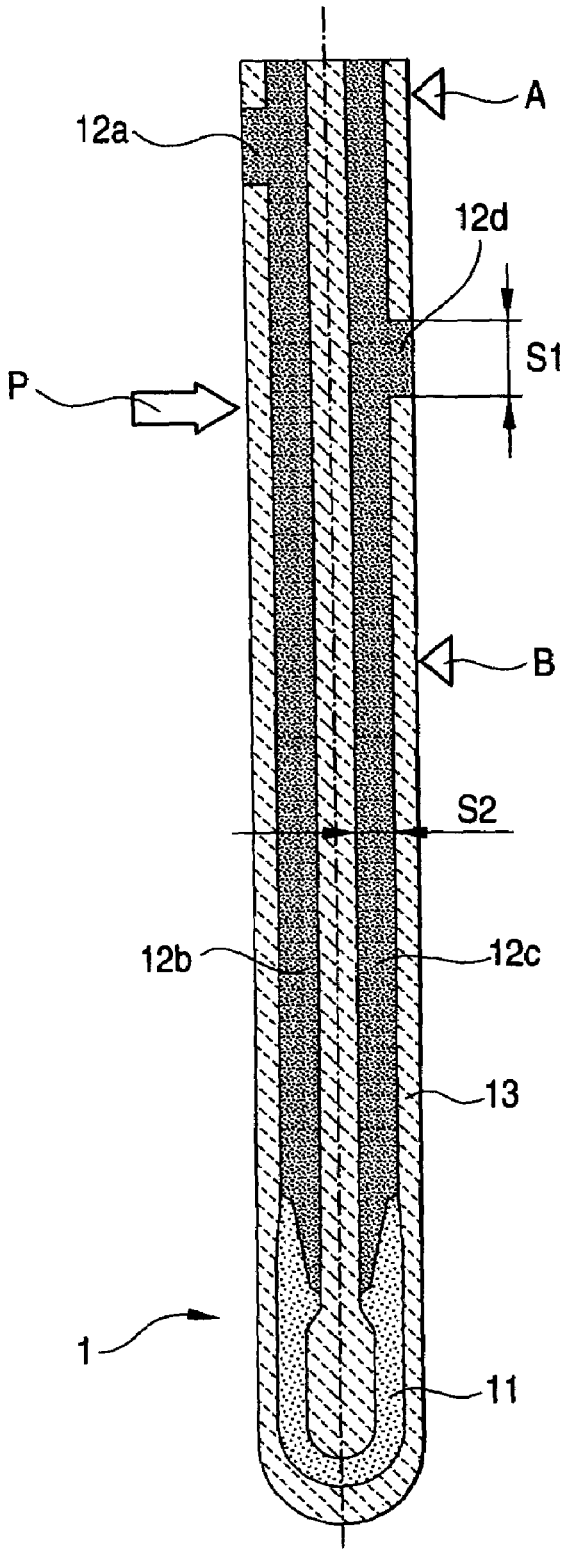
FIG. 6 is a sectional view of the ceramic heater used in Test Examples 1, 2.

The fired body thus obtained was ground to produce the ceramic heater 1 used in Examples 1-1 to 1-3 and Comparative Examples 1-1 and 1-2 as shown in FIGS. 5(A) to 5(C) and FIG. 6. In the thus obtained ceramic heater, the electrode parts 12*a*, 12*d* form a rough hexagon as viewed from the lateral direction when the ceramic heater 1 is provided in a horizontal direction, and the horizontal length a is made longer than the vertical width b, as shown in FIG. 5(C). Each ceramic heater 1 has a diameter of 3.3 mm and an overall length of 45 mm. Table 1 also lists the ratio between cross-sectional area S1 of the electrode parts 12*a*, 12*d* in a direction along an axis of the ceramic heater 1 and the cross-sectional area S2 in a direction perpendicular to the axis of the ceramic heater 1 as shown in FIG. 6.

Each ceramic heater 1 was combined with the metal shell 4, connection fitment 17, and other members, to thereby complete the glow plug 50 shown in FIG. 1.

Break-resistant strength measurement of each ceramic heater 1, energization durability of the glow plug 50 using each ceramic heater 1, and temperature measurement around the electrode parts 12*a*, 12*d* were determined according to the following measurement methods:

1. Break-Resistant Strength (Three-Point Bending Strength) Measurement

The following break-resistant strength measurement method conforming to JIS R 1601 (1994) was carried out to assess susceptibility of each ceramic heater 1 to breakage. A single unit of each ceramic heater 1 was supported at supporting points A and B (span 12 mm) across the electrode part 12*d* and a load was imposed on load point P at a cross head move speed of 0.5 mm/minute, as shown in FIG. 6. The ambient temperature at the measurement time was room temperature. Load point P on the surface of substrate 13 (corresponding to the position where the electrode parts 12*a*, 12*d* are buried) was selected to best demonstrate the advantages of the invention with respect to break-resistant strength.

2. Energization Durability Test

An energization durability test for repeating an energization state and a non-energization state was conducted for each ceramic heater 1 to evaluate the durability of the connection part of each ceramic heater 1 and the metal cylinder 3 or the metal ring 18. The energization cycle constitutes placing the ceramic heater in an energization state for one minute and then in a non-energization state for one minute. The cycle is then repeated. In the one-minute energization state, the tip end part of the ceramic heater 1 is heated to about 1350° C.

3. Temperature Measurement Around Electrode Part

The highest temperature (° C.) of the electrode parts 12*a*, 12*d* was measured at the time of the energization durability test described above.

Table 2 lists the results of the break-resistant strength test, the energization durability test, and the measured temperature around the electrode part while varying the ratio between the cross-sectional areas S1 and S2. As used herein, "NG" means "not good".

TABLE 2

| | Break-resistant strength (three-point bending strength) (MPa) | Energization durability test | Temperature around electrode part (° C.) | Evaluation |
|---|---|---|---|---|
| Example 1-1 | 800 | 10000 cycles OK | 300 | Very Good |
| Example 1-2 | 1000 | 10000 cycles OK | 250 | Very Good |
| Example 1-3 | 1100 | 10000 cycles OK | 220 | Very Good |
| Comparative Example 1-1 | 1150 | 3000 cycles or less NG | 400 | Poor |
| Comparative Example 1-2 | 1130 | 4000 cycles or less NG | 350 | Poor |

As shown in Table 2, the ceramic heater 1 of Examples 1-1 to 1-3 had a break-resistant strength of 800 MPa or more, namely, sufficient strength, and the temperature of the electrode parts 12*a*, 12*d* increased only to 300° C. or less during the energization durability test. Also, degradation of the electrode parts 12*a*, 12*d* was not observed in the durability test of 10000 cycles. The electrode parts 12*a*, 12*d* of the ceramic heater 1 of Examples 1-1 to 1-3 resist an increase in temperature because the electrical resistance value of the electrode parts 12*a*, 12*d* is equal to or less than that of the lead parts 12*b*, 12*c*. Another reason is that the connection part for energizing the one electrode part 12*a* through the metal ring 18 from the center pole 6 and the connection part for energizing the other electrode part 12*d* through the metal cylinder 3 from the metal shell 4 are made sufficiently large. Thus, the electrical resistance value of each of the connection parts is the smallest in the energization path of the ceramic heater 1. Thus, if the electrode parts 12*a*, 12*d* are exposed to oxygen in the open air in the presence of a gap with the metal cylinder 3 or the metal ring 18, oxidation and swelling are suppressed.

On the other hand, the ceramic heater 1 of Comparative Examples 1-1, 1-2 had a break-resistant strength of 1130 MPa or more, namely, sufficient strength, but as of the result of the energization durability test, the temperature of the electrode parts 12*a*, 12*d* increased to 350° C. or more and degradation of the electrode parts 12*a*, 12*d* was observed at 4000 cycles or less. The temperature of electrode parts 12*a*, 12*d* of the ceramic heater 1 of Comparative Examples 1-1, 1-2 readily increased because the electrical resistance value of the electrode parts 12*a*, 12*d* exceeded that of the lead parts 12*b*, 12*c* and the connection part with the metal cylinder 3 or the metal ring 18 was small. Thus, if the electrode parts 12*a*, 12*d* are exposed to oxygen in the open air in the presence of a gap with the metal cylinder 3 or the metal ring 18, oxidation advances to result in swelling.

Therefore, as compared with the ceramic heater 1 of Comparative Examples 1-1, 1-2, the ceramic heater 1 of Examples 1-1 to 1-3 demonstrates high durability over long term use.

Particularly, in each of the ceramic heaters 1 of Examples 1-2 and 1-3, the ratio between the cross-sectional areas S1 and S2 is 1.5 or more and thus both temperature rise of the electrode parts 12*a*, 12*d* and degradation of the break-resistant strength can be effectively suppressed. Since the ratio between the cross-sectional areas S1 and S2 in the ceramic heater 1 of Example 1-3 is larger than that in the ceramic heater 1 of Example 1-2, the advantages of the invention are more apparent than in the ceramic heater 1 of Example 1-2.

However, if the cross-sectional area S1 of the electrode parts 12*a*, 12*d* is made excessively large, the cross-sectional area change between the electrode parts 12*a*, 12*d* and the lead parts 12*b*, 12*c* in the ceramic heater 1 becomes steep and there is a concern that a conduction path may break in the lead parts 12*b*, 12*c* and that energization durability may be reduced. Thus, preferably, the cross-sectional area S1 of the electrode parts 12*a*, 12*d* is one to two times the cross-sectional area S2 of the lead parts 12*b*, 12*c*.

Each Of the ceramic heaters 1 of Examples 1-1 to 1-3 provides the advantage described above although having a very thin diameter of 3.3 mm. Thus, if one of the ceramic heaters 1 is adopted for the glow plug 50, it is possible to provide a high-performance diesel engine because the glow plug 50 has a thin diameter and is highly durable.

Further, in the manufacturing method of the ceramic heaters 1 in Examples 1-1 to 1-3, the incline angle a of the sidewalls in the molding tool 90 with respect to the joint faces 91*a*, 92*a* is 75 degrees, so that the occurrence of cracking defects, chipping, etc., in both projection parts 52*a* and 52*d* of the molded green body 40 is suppressed. Table 3 lists the results of changing the incline angle α of the sidewalls 91*b*, 92*b* from 65° to 85°.

TABLE 3

| | Slope angle α (°) | | | | |
|---|---|---|---|---|---|
| | 65 | 70 | 75 | 80 | 85 |
| Manufacturing process | Good | Good | Good | Good | Bad |
| At operating time | Bad | Good | Good | Good | Even |

As shown in Table 3, if the incline angle α is larger than 80°, the draft angle of the sidewalls 91*b*, 92*b* becomes insufficient and the molded green body 40 is not easily removed. Consequently, cracking defects, chipping, etc., readily occur in both projection parts 52*a* and 52*d* of the molded green body 40. If the incline angle α is smaller than 70°, the molded green body 40 can be easily removed, but a part of the projection parts 52*a*, 52*d* which becomes a ridgeline in the presence of the joint faces 91*a*, 92*a* tends to be sharpened where stress concentrates, and cracking defects, chipping, etc., readily occur in both projection parts 52*a* and 52*d* of the molded green body 40.

On the other hand, if the incline angle a is set within a range of 70° to 80°, the sidewalls 91*b*, 92*b* have an appropriate draft angle and the occurrence of cracking defects, chipping, etc., in both projection parts 52*a* and 52*d* of the molded green body 40 can be effectively suppressed. Thus, degradation of the strength of the ceramic heater 1 manufactured using the molded green body 40 and an increase in contact resistance of the electrode parts 12*a*, 12*d* can also be suppressed.

TEST EXAMPLE 2

Test Example 2 is an evaluation for determining whether the ceramic heater 1 has sufficient break-resistant strength and whether breakage, etc., during manufacturing or installation, etc., can be suppressed as the material of the electrode parts 12*a*, 12*d* for the ceramic heater 1 of Test Example 1 is changed. The lead parts 12*b* and 12*c* are made of the same material as the electrode parts 12*a* and 12*d*. Test Example 2 includes Examples 2-1 to 2-8 and Comparative Examples 2-1 to 2-9.

In the ceramic heaters 1 of Examples 2-1 to 2-8 and Comparative Examples 2-1 to 2-9, the compounding ratio between the insulating material and WC of the electrode parts 12*a* and 12*d* and the content of $SiO_2$ and $Er_2O_3$ in the insulating material was changed as indicated in Table 4. The structure and manufacturing method of the ceramic heater 1, the structure of the glow plug 50 manufactured using the ceramic heater 1, and the like are as described in Test Example 1 and therefore will not be repeated.

TABLE 4

| | Insulating material (% by weight) | WC (% by weight) | Content (% by weight) of ($SiO_2$ + $Er_2O_3$) in insulating material {($SiO_2$ + $Er_2O_3$)/insulating material} | Axial cross-sectional area of electrode part/cross-sectional area in direction perpendicular to axis of lead part (S1/S2) |
|---|---|---|---|---|
| Example 2-1 | 35 | 65 | 15 | 1.5 |
| Example 2-2 | 33 | 67 | 10 | 1.5 |
| Example 2-3 | 33 | 67 | 15 | 1.0 |
| Example 2-4 | 33 | 67 | 15 | 1.5 |
| Example 2-5 | 33 | 67 | 15 | 2.0 |
| Example 2-6 | 33 | 67 | 15 | 2.5 |
| Example 2-7 | 33 | 67 | 20 | 1.5 |

TABLE 4-continued

| | Insulating material (% by weight) | WC (% by weight) | Content (% by weight) of ($SiO_2$ + $Er_2O_3$) in insulating material {($SiO_2$ + $Er_2O_3$)/ insulating material} | Axial cross-sectional area of electrode part/cross-sectional area in direction perpendicular to axis of lead part (S1/S2) |
|---|---|---|---|---|
| Example 2-8 | 30 | 70 | 15 | 1.5 |
| Comparative Example 2-1 | 40 | 60 | 15 | 1.5 |
| Comparative Example 2-2 | 37 | 63 | 15 | 1.5 |
| Comparative Example 2-3 | 33 | 67 | 5 | 1.5 |
| Comparative Example 2-4 | 33 | 67 | 8 | 1.5 |
| Comparative Example 2-5 | 33 | 67 | 15 | 0.5 |
| Comparative Example 2-6 | 33 | 67 | 22 | 1.5 |
| Comparative Example 2-7 | 33 | 67 | 25 | 1.5 |
| Comparative Example 2-8 | 28 | 72 | 15 | 1.5 |
| Comparative Example 2-9 | 25 | 75 | 15 | 1.5 |

Break-resistant strength measurement on the ceramic heaters 1 of Examples 2-1 to 2-8 and Comparative Examples 2-1 to 2-9, an attachment (installation) test of the glow plug 50 employing each of the ceramic heaters 1 of Examples 2-1 to 2-8 and Comparative Examples 2-1 to 2-9 to a cylinder head, and energization durability test of the glow plug 50 were conducted.

the compounding ratio between the insulating material and WC is variously changed for the material forming the electrode parts 12*a* and 12*d*. In Examples 2-1, 2-4, and 2-6 and Comparative Examples 2-1, 2-2, 2-8, and 2-9 in Table 5, the content of $SiO_2$ and $Er_2O_3$ based on 100% by weight of the insulating material was 15% by weight.

TABLE 5

| | Insulating material (% by weight) | WC (% by weight) | Break-resistant strength (three-point bending strength) (MPa) | Attachment test (number of NG tests) | Energization durability test |
|---|---|---|---|---|---|
| Example 2-1 | 35 | 65 | 1100 | 0/10 | 10000 cycles OK |
| Example 2-4 | 33 | 67 | 1000 | 0/10 | 10000 cycles OK |
| Example 2-6 | 30 | 70 | 920 | 0/10 | 10000 cycles OK |
| Comparative Example 2-1 | 40 | 60 | 1200 | 0/10 | Heat generation failure |
| Comparative Example 2-2 | 37 | 63 | 1200 | 0/10 | Heat generation failure |
| Comparative Example 2-8 | 28 | 72 | 400 | 4/10 | — |
| Comparative Example 2-9 | 25 | 75 | 350 | 5/10 | — |

The attachment test of glow plug 50 to a cylinder head was conducted as follows: To determine the possibility of occurrence of problems such as breakage, etc., in attaching the glow plug 50 to a diesel engine, each glow plug 50 was attached to a cylinder head and was fastened with an impact wrench. Subsequently, continuity of the ceramic heaters 1 was checked. The fastening condition with the impact wrench was repeated five times at a drive air pressure of 0.5 MPa (5 kgf/$cm^2$). The break-resistant strength measurement and the energization durability test are as described in Test Example 1.

Table 5 lists the results of the break-resistant strength test, the attachment test, and the energization durability test when Table 5 shows that when the compounding ratio of WC in the electrode parts 12*a*, 12*d* is increased, the break-resistant strength of the single unit ceramic heater 1 is decreased and when the compounding ratio of WC is decreased, the break-resistant strength of the single unit ceramic heater 1 is enhanced. For example, the ceramic heater of Comparative Example 2-8 having a WC compounding ratio of 72% by weight had a break-resistant strength of only 400 MPa and internal breakage due to the fastening load of the impact wrench occurred frequently. Thus, the compounding ratio of WC is desirably set to 70% by weight or less as seen from Table 5.

On the other hand, if the compounding ratio of WC is decreased too much, the electrical resistance value of the electrode parts 12*a*, 12*d* increases and heat generation failure occurs in the energization durability test, etc., as shown in Comparative Examples 2-1 and 2-2. As a result, the ceramic heater 1 is no longer practically useful. Thus, the compounding ratio of WC needs is desirably set to 65% by weight or more as seen from Table 5.

Next, Table 6 lists the results of the break-resistant strength test, the attachment test, and the energization durability test when the content (% by weight) of $SiO_2$ and $Er_2O_3$, based on 100% by weight of the insulating material, is variously changed. In Examples 2-1, 2-4, and 2-7 and Comparative Examples 2-3, 2-4, 2-6, and 2-7 listed in Table 6, the compounding ratio of WC was set so as to be within the range of 65% by weight to 70% by weight, the desired range of WC derived from the above description. Specifically, the compounding ratio of WC was set to 67% by weight. In Examples 2-1, 2-4, and 2-7 and Comparative Examples 2-3, 2-4, 2-6, and 2-7 in Table 6, the axial cross-sectional area of the electrode parts 12*a*, 12*d*, S1/the cross-sectional area in a direction perpendicular to the axis of the lead parts 12*b*, 12*c*, S2 was set to 1.5.

TABLE 6

| | Content (% by weight) of ($SiO_2$ + $Er_2O_3$) in insulating material {($SiO_2$ + $Er_2O_3$)/ insulating material } | Break-resistant strength (three-point bending strength) (MPa) | Attachment test (number of NG tests) | Energization durability test |
|---|---|---|---|---|
| Example 2-2 | 10 | 920 | 0/10 | 10000 cycles OK |
| Example 2-4 | 15 | 1000 | 0/10 | 10000 cycles OK |
| Example 2-7 | 20 | 980 | 0/10 | 10000 cycles 0K |
| Comparative Example 2-3 | 5 | 300 | 5/10 | — |
| Comparative Example 2-4 | 8 | 400 | 5/10 | — |
| Comparative Example 2-6 | 22 | 750 | 0/10 | 5000 cycles NG |
| Comparative Example 2-7 | 25 | 830 | 0/10 | 5000 cycles NG |

Consequently, as shown in Comparative Examples 2-3 and 2-4, when the content of $SiO_2$ and $Er_2O_3$ was less than 10% by weight, even when the compounding ratio of WC was set within the desired range mentioned above, the electrode parts 12*a*, 12*d* were insufficiently solid and the break-resistant strength of the single unit ceramic heater 1 was considerably degraded to 400 MPa. Further, in this case, a problem of the ceramic heater 1 breaking due to the fastening load of the impact wrench occurred frequently in the attachment test.

In contrast, as the content of $SiO_2$ and $Er_2O_3$ is increased, the break-resistant strength reaches a peak and then begins to degrade again, as shown in Example 2-4.

As shown in Comparative Examples 2-6 and 2-7, when the content of $SiO_2$ and $Er_2O_3$ exceeds 20% by weight, the break-resistant strength is still in the neighborhood of 800 MPa and a problem of the ceramic heater 1 breaking or the like does not occur in the attachment test. However, as the content of $SiO_2$ and $Er_2O_3$ is increased, new problems of strength degradation and reduced heat resistance caused by an increase in the glass component, etc., become noticeable. In fact, in Comparative Examples 2-6 and 2-7, such problems occurred at about 5000 to 6000 cycles in the energization durability test under high-temperature conditions.

Thus, the content of $SiO_2$ and $Er_2O_3$ in the insulating material is desirably set within a range of 10% by weight to 20% by weight as seen from Table 6.

Therefore, in the ceramic heater 1, the electrode parts 12*a*, 12*d* constitute a fired body made of an insulting material comprising silicon nitride in an amount of 30% by weight to 35% by weight and conductive WC in an amount of 65% by weight to 70% by weight. In addition thereto, the insulating material contains 10% by weight to 20% by weight of $SiO_2$ and $Er_2O_3$ (based on the weight of the insulating material), whereby the strength of the electrode parts 12*a*, 12*d* as a fired body can be enhanced. This kind of ceramic heater has sufficient break-resistant strength, such that breakage, etc., during manufacturing or installation, etc., can be suppressed.

To check the connection part of the electrode parts 12*a*, 12*d* and the metal cylinder 3 or the metal ring 18 of each ceramic heater 1 for broken conduction paths, etc., while attaching a glow plug including the ceramic heater to a cylinder head or the like, the cross-sectional area S1/cross-sectional area S2 was changed for evaluation. Table 7 shows the results.

TABLE 7

| | (Axial cross-sectional area of electrode part)/(cross-sectional area in direction perpendicular to axis of lead part) (S1/S2) | Break-resistant strength (three-point bending strength) (MPa) | Attachment test (number of NG tests) | Energization durability test |
|---|---|---|---|---|
| Example 2-3 | 1.0 | 800 | 0/10 | 10000 cycles OK |
| Example 2-4 | 1.5 | 1000 | 0/10 | 10000 cycles OK |
| Example 2-5 | 2.0 | 1100 | 0/10 | 10000 cycles OK |
| Example 2-6 | 2.5 | 1150 | 0/10 | *Reference value 3000 cycles NG |
| Comparative Example 2-5 | 0.5 | 700 | 1/10 | — |

In Examples 2-3, 2-4, 2-5, and 2-6 and Comparative Example 2-5 listed in Table 7, the compounding ratio of WC was set to be within the range of 65% by weight to 70% by weight, the desired range of WC derived in the above description. Specifically, the compounding ratio of WC was 67% by weight. In Examples 2-3, 2-4, 2-5, and 2-6 and Comparative Example 2-5 in Table 7, the content of $SiO_2$ and $Er_2O_3$ was set to be within the range of 10% by weight to 20% by weight, the desired content range of $SiO_2$ and $Er_2O_3$ derived in the above description. Specifically, the content of $SiO_2$ and $Er_2O_3$ based on 100% by weight of the insulating material was 15% by weight.

As seen from Table 7, as in Comparative Example 2-5, when the cross-sectional area S1 of the electrode parts 12*a*, 12*d* is smaller than the cross-sectional area S2 of the lead parts 12*b*, 12*c*, the connection part of the electrode parts 12*a*, 12*d* and the metal cylinder 3 or the metal ring 18 is small and there is increased concern of a broken conduction path in the connection part caused by shock or distortion during installation. In this case, local heat generation due to a small connection part also introduces a problem. In fact, in Comparative Example 2-5, NG occurring as a broken conduction path is caused by shock during installation because of the weak connection part in the attachment test.

In contrast, as in Examples 2-3 to 2-6, the cross-sectional area S1 of the electrode parts 12*a*, 12*d* is made equal to or larger than the cross-sectional area S2 of the lead parts 12*b*, 12*c*, whereby the electrical resistance value of the electrode parts 12*a*, 12*d* becomes equal to or less than that of the lead parts 12*b*, 12*c*. Also, the connection part of the electrode parts 12*a*, 12*d* and the metal cylinder 3 or the metal ring 18 can be made sufficiently large and the concern of a broken conduction path in the connection part can also be eliminated due to shock or distortion imparted during installation.

However, if the cross-sectional area S1 of the electrode parts 12*a*, 12*d* is excessively large, the cross-sectional area change between the electrode parts 12*a*, 12*d* and the lead parts 12*b*, 12*c* in the ceramic heater 1 is steep. Consequently, a broken conduction path may occur in the lead parts 12*b*, 12*c* and energization durability may be degraded as in Example 2-6. Thus, preferably, the cross-sectional area SI of the electrode parts 12*a*, 12*d* is one to two times the cross-sectional area S2 of the lead parts 12*b*, 12*c*.

According to the above results, in the ceramic heaters 1 of Examples 2-3 to 2-6, the cross-sectional area S1 of the electrode parts 12*a*, 12*d* is made equal to or larger than the axial cross-sectional area S2 of the lead parts 12*b*, 12*c*, so that occurrence of a broken conduction path, etc., while installing the ceramic heater to a cylinder head or the like can be suppressed for the connection part of the electrode parts 12*a*, 12*d* and the metal cylinder 3 or the metal ring 18. Thus, energization failure, etc., can also be prevented for the glow plug 50 incorporating the ceramic heater 1.

The invention can be applied not only to the ceramic heater 1 where at least the lead parts 12*b* and 12*c* and the electrode parts 12*a* and 12*d* are injection-molded as described above, but also to a ceramic heater where at least the lead parts 12*b* and 12*c* and the electrode parts 12*a* and 12*d* are each a metal lead wire.

In the ceramic heater of the invention, the shapes, etc., of the lead parts 12*b* and 12*c*, the electrode parts 12*a* and 12*d*, and the resistor 11 shown in the accompanying drawings represent only one embodiment of the invention, and the ceramic heater is not limited thereto. Any of various general methods can also be selected for the wiring method and the method of attaching the metal shell 4 and the center pole 6 and the ceramic heater 1.

The ceramic heater of the invention can be adapted for use with a glow plug, etc., for example.

It should further be apparent to those skilled in the art that various changes in form and detail of the invention as shown and described above may be made. It is intended that such changes be included within the spirit and scope of the claims appended hereto.

This application is based on Japanese Patent application JP 2004-191025, filed Jun. 29, 2004, and Japanese Patent application JP 2004-191027, filed Jun. 29, 2004, the entire contents of which are hereby incorporated by reference, the same as if set forth at length.

What is claimed is:

1. A ceramic heater having a longitudinal axis comprising:

a cylindrical substrate comprising an insulator;

a resistor provided in one end side of said substrate;

a pair of lead parts provided in said substrate, connected to said resistor and extending to an opposite end side of said substrate; and a pair of electrode parts exposed at a surface of an opposite end side of said substrate and connected respectively to said lead parts, wherein both lead parts are made of the same material as both electrode parts, and a cross-sectional area of an electrode part in a direction along said longitudinal axis of said ceramic heater is larger than a cross-sectional area of a lead part connected to said electrode part in a direction perpendicular to said longitudinal axis of said ceramic heater.

2. The ceramic heater as claimed in claim 1, wherein the axial cross-sectional area of said electrode part is 1.5 times or more than the cross-sectional area of said lead part in a direction perpendicular to said longitudinal axis of said ceramic heater.

3. The ceramic heater as claimed in claim 1, wherein said substrate comprises a silicon nitride material, each of said electrode parts is a fired body comprising from 30 to 35% by weight of an insulating material comprising silicon nitride and 65% to 70% by weight of WC, and said insulating material comprises 10% to 20% by weight, based on the content of the insulating material, of at least one of $SiO_2$ and $Re_2O_3$ where RE represents a rare-earth element.

4. The ceramic heater as claimed in claim 1, wherein said substrate has a diameter of 3.5 mm or less.

5. A glow plug comprising:

a cylindrical metal shell;

a ceramic heater as claimed in claim 1 provided in a tip end side of said metal shell and including a heating part at a tip end of said ceramic heater; and a center pole provided in a rear end side of said metal shell.

6. A method for manufacturing a ceramic heater, said ceramic heater comprising:

a cylindrical substrate comprising an insulator;

a resistor provided in one end side of said substrate;

a pair of lead parts provided in said substrate, connected to said resistor and extending to an opposite end side of said substrate; and a pair of electrode parts exposed at a surface of an opposite end side of said substrate and connected respectively to said lead parts, wherein both lead parts are made of the same material as both electrode parts, and a cross-sectional area of an electrode part in a direction along said longitudinal axis of said ceramic heater is larger than a cross-sectional area of a lead part connected to said electrode part in a direction perpendicular to said longitudinal axis of said ceramic heater, said method comprising:

forming a molded green body using a molding tool, the molded green body including a resistor green part, a pair of lead green parts, and a pair of electrode green parts; and firing a green body assembly comprising a substrate green body and the molded green body provided in said substrate green body so as to form a ceramic heater including a substrate, a resistor, a pair of lead parts and a pair of electrode parts from said respective green parts, wherein said molding tool comprises a first mold and a second mold, each of said first and second molds having a joint face at which said first and second molds can be separated from each other, and a cavity for forming the molded green body, and wherein the cavity of each of said first and second molds includes a pair of inwardly inclined opposing sidewalls for forming said electrode green parts, each of said sidewalls defining an acute angle with the joint face.

7. The method as claimed in claim 6, wherein each of said sidewalls is inclined at an angle of 70 to 80 degrees with respect to said joint face.

* * * * *